US006491455B1

(12) United States Patent
Bryant

(10) Patent No.: US 6,491,455 B1
(45) Date of Patent: Dec. 10, 2002

(54) RIBBON TRACKING SYSTEM

(75) Inventor: Caleb Bryant, Moorpark, CA (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/921,098

(22) Filed: Jul. 31, 2001

(51) Int. Cl.[7] ..... B41J 35/08; B41J 17/30
(52) U.S. Cl. ..... 400/234; 400/248
(58) Field of Search ..... 400/247, 248, 400/234; 226/196.1; 242/615

(56) References Cited

U.S. PATENT DOCUMENTS

| | | | | |
|---|---|---|---|---|
| 4,084,683 A | | 4/1978 | Moss | 400/248 |
| 5,251,844 A | * | 10/1993 | Albrecht et al. | 242/179 |
| 5,342,131 A | | 8/1994 | Nakajima et al. | 400/120.1 |
| 5,738,449 A | | 4/1998 | Groswith, III et al. | 400/234 |
| 5,938,356 A | | 8/1999 | Wirth et al. | 400/636.3 |
| 6,123,471 A | | 9/2000 | Harb et al. | 400/248 |
| 6,361,228 B1 | * | 3/2002 | Barrus et al. | 400/234 |
| 2002/0080224 A1 | * | 6/2002 | Forster | 347/217 |

* cited by examiner

*Primary Examiner*—Huan Tran
(74) *Attorney, Agent, or Firm*—Fulbright & Jaworski LLP

(57) ABSTRACT

A ribbon tracking system for use in a printer, scanner or the like includes a carbon fiber-based plastic printer wire shroud having a first portion coupled to the printer ribbon frame downstream from the printhead, a second portion spaced apart from and generally parallel to the first portion and adapted to contact a moving ribbon at a curved front edge during printer operation, and a substantially small integral neck portion coupled centrally between the first and second portions. The neck portion functions as a living hinge permitting the second portion to deflect toward and/or away from the first portion, or in any combination of directions thereof, to automatically equalize stress differentials between various portions of the moving ribbon so as to prevent wrinkling and/or buckling, of the ribbon.

21 Claims, 4 Drawing Sheets

RIBBON TRACKING SYSTEM

BACKGROUND OF THE INVENTION

1. Field of the Invention

The present invention relates generally to printer ribbon tracking systems and more particularly to a ribbon tracking system for a thermal transfer printer which uses a plate for covering printer wiring under the ribbon frame which has a head portion gimbaled centrally on a small integral neck portion and adapted to deflect according to the movement of the ribbon.

2. Prior Art

Various attempts have been made in the past to provide effective means for correcting errors in ribbon tracking during printer operation. Most attempts, however, have either been implemented with limited success, or have been associated with high manufacturing costs, or both.

For example, U.S. Pat. No. 4,084,683 to Moss discloses a ribbon tracking system which includes guide means and roller means thereon which automatically tilts with the moving ribbon to correct errors in tracking of the ribbon. The system also includes a crowned pulley which is floatingly supported and journaled on a curved guide post with the pulley being axially moved along the guide post in a direction generally opposite the tracking error to correct the attitude of the moving ribbon. When a tracking error occurs due to an unbalance of forces acting on the ribbon and the centerline of the ribbon does not align with the radius of curvature of the guide post, the forces on the crowned pulley cause the pulley to center itself with respect to the moving ribbon. A ribbon tracking system of this kind is rather costly to manufacture, assemble and/or maintain due to its complex design.

Another example is commonly assigned U.S. Pat. No. 6,123,471 to Harb et al, which discloses a medium tracking bar mounted on a printer ribbon mechanism by way of La V-shaped metal flange which has a central aperture for receiving a compression spring-loaded screw. The screw and the compression spring function as a central pivot means for the medium tracking bar. The compression spring provides a force that resists pulling in and/or pushing away the medium tracking bar from a balanced central position. the resisting force is used to counteract the uneven stresses on a misaligned moving ribbon. This type of centrally pivoted and spring loaded medium tracking bar, although an improvement over the above-described Moss setup, involves a number of relatively costly components and requires a certain amount of assembly time which adds to the overall manufacturing cost of the system.

SUMMARY OF THE INVENTION

The present invention is directed to a ribbon tracking system for use in an image forming device having a printhead coupled to a ribbon frame comprising a plate including a first portion coupled to the ribbon frame downstream from the printhead and a second portion spaced apart from the first portion and adapted to contact a moving ribbon at a first edge. The plate also comprises a substantially small integral neck region between the first and second portions adapted to permit the second portion to deflect toward and/or away from the first portion to help equalize stress differentials between various portions of the moving ribbon to prevent wrinkling of the ribbon.

These and other aspects of the present invention will become apparent from a review of the accompanying drawings and the following detailed description of the preferred embodiments of the present invention.

BRIEF DESCRIPTION OF THE DRAWINGS

The present invention is shown by way of example in the accompanying which.

DETAILED DESCRIPTION OF THE PREFERRED EMBODIMENTS

Figure 1:
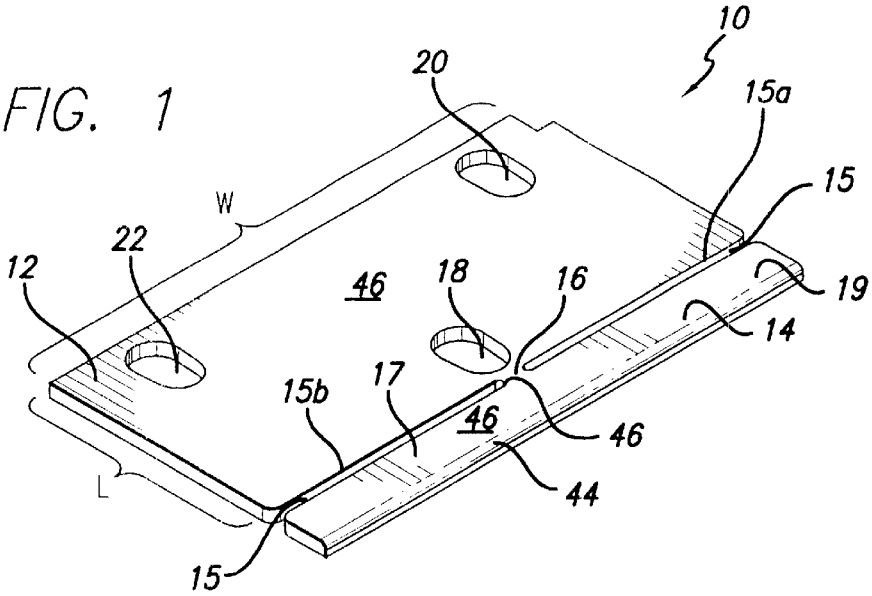
FIG. 1 is a top perspective view of a ribbon tracking system in accordance with the present invention.

Hereinafter, some preferred embodiments of the present invention will be described in detail with reference to the related drawings of FIGS. 1–5. Additional embodiments, features and/or advantages of the invention will become apparent from the ensuing description or may be learned by the practice of the invention.

In the figures, the drawings are not to scale and reference numerals indicate the various features of the invention, like numerals referring to like features throughout both the drawings and the description.

The following description includes the best mode presently contemplated for carrying out the invention. This description is not to be taken in a limiting sense, but is made merely for the purpose of describing the general principles of the invention.

The present invention is directed to a ribbon tracking system for use in a printer, scanner or the like which comprises a plate (or shroud) for covering printer wiring under the ribbon frame which has a first portion coupled under the printer ribbon frame downstream from the printhead, a second portion spaced apart from and generally parallel to the first portion wherein the second portion is in contact with a moving ribbon at a curved front edge during printer operation, and a substantially small integral neck region coupled centrally between the first and second portions. The first portion, the second portion and the integral neck region are injection molded as one integral unit from a rigid carbon fiber plastic composition. The neck region functions as a living hinge and permits the second portion to deflect toward and/or away from the first portion during printer operation to automatically equalize stress differentials between various portions of the moving ribbon so as to prevent wrinkling of the ribbon during printer operation.

Figure 2:
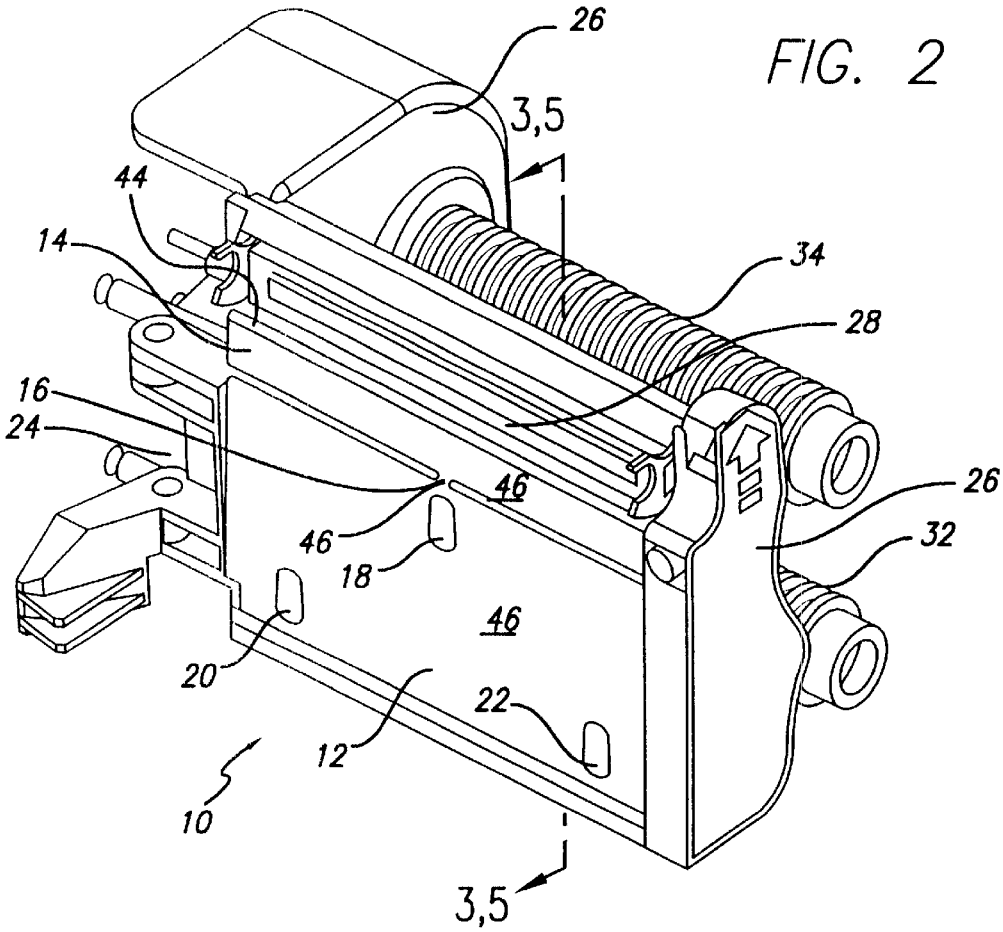
FIG. 2 is a bottom perspective view of the ribbon tracking system of FIG. 1 mounted on the underside of a printer ribbon frame in accordance with the present invention.
Figure 4:
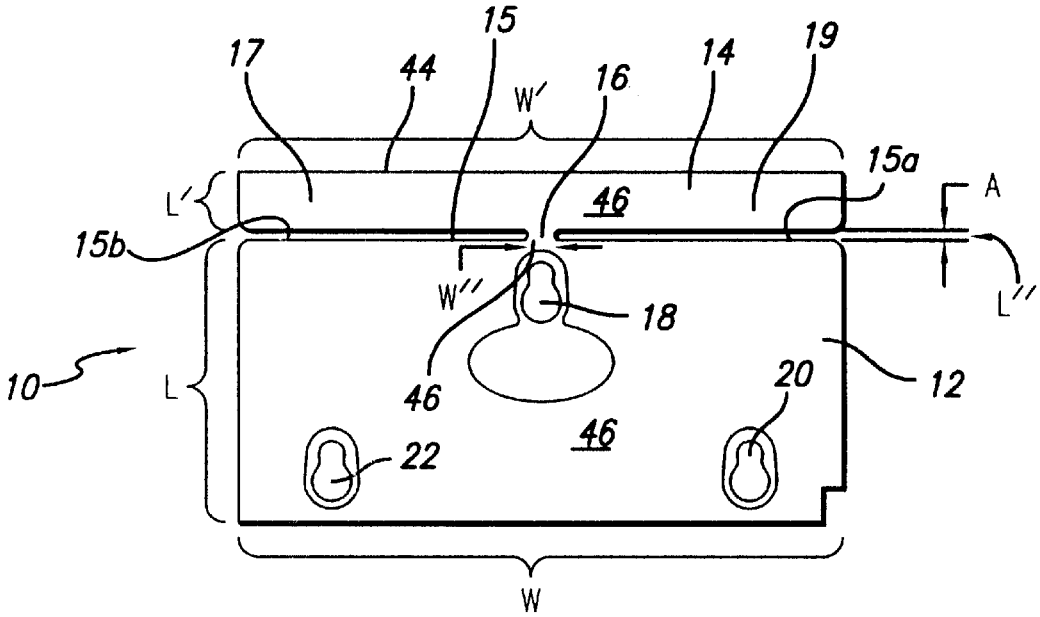
FIG. 4 is a bottom plan view of the ribbon tracking system of FIG. 1.
Figure 5:
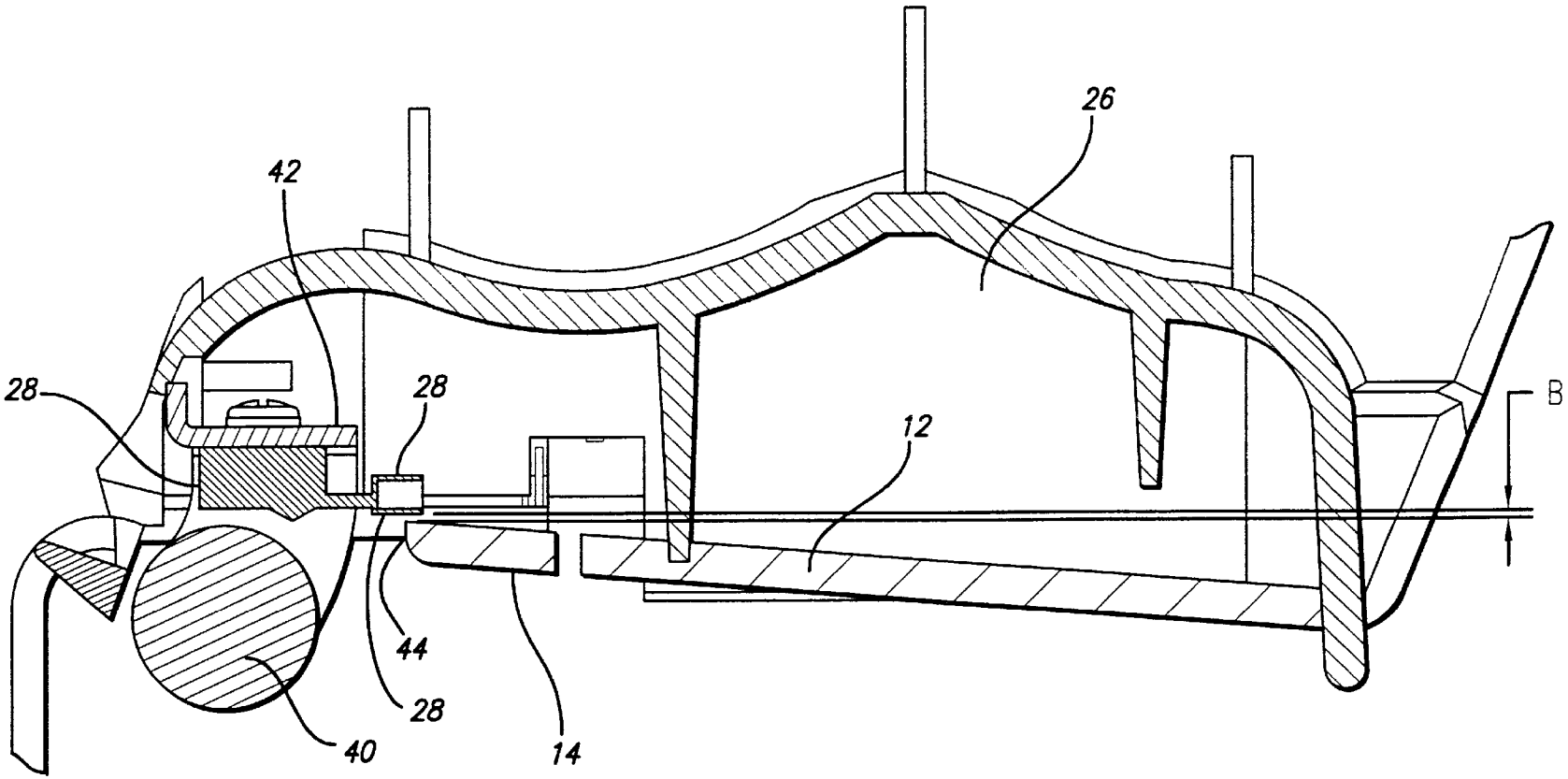
FIG. 5 is a partial cross-sectional view taken along section line 5—5 of FIG. 2.

Turning to FIGS. 1–2, a ribbon tracking system, generally referred to by a reference numeral 10, comprises a plastic polygonal plate (or shroud) 12 used to cover printer wires under a printer ribbon frame 26 which is preferably adapted on one side to provide automatic ribbon tracking capability to prevent wrinkling of a moving ribbon during printer operation. Automatic ribbon tracking is achieved by providing an integral generally rectangular gimbaling plate 14 coupled centrally to a front side 15 of wire shroud 12 by means of an integral substantially small neck portion or region 16 which is generally of the same thickness as the body of wire shroud 12 and gimbaling plate 14. Integral gimbaling plate 14 has a right side 17 (disposed to the right of neck portion 16) and a left side 19 (disposed to the left of neck portion 16) spaced apart at a predetermined determined distance from and generally parallel to side 15 of wire shroud 12 as illustrated in FIG. 1. Gimbaling plate 14 is generally of the same width but of shorter length relative to the body of wire shroud 12. Wire shroud 12 has a width W and a length L, respectively, as generally shown in FIGS. 1, 4.

Integral gimbaling plate 14 and neck portion 16 are preferably made of the same plastic material as wire shroud 12. Wire shroud 12 is provided with mounting slots 18, 20, 22 for screw-mounting wire shroud 12 to an underside 24 of printer ribbon frame 26 such that gimbaling plate 14 is preferably disposed proximate to and to a certain extent under a thermal transfer printhead 28 mounted to underside 24 of ribbon frame 26 upstream as depicted in FIG. 2.

Figure 3:
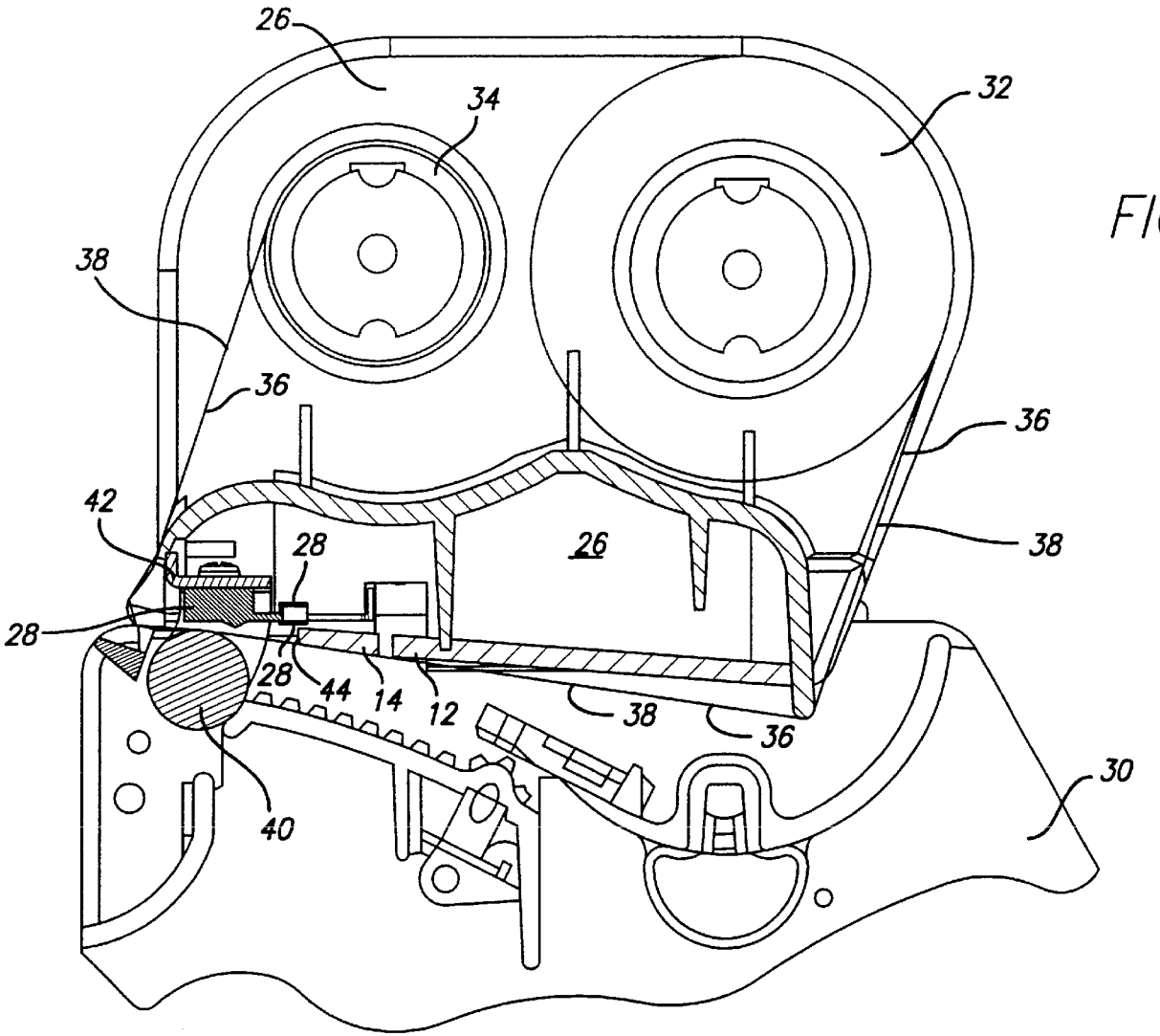
FIG. 3 is a cross-sectional view taken along section line 3—3 of FIG. 2.

As generally illustrated in FIG. 3, printer ribbon frame 26 is disposed over a printer base 30 of a thermal transfer printer (not shown) and supports a ribbon supply roll 32 and a ribbon take up roll 34 which generally define a ribbon path 36 for a moving ribbon 38 which is conventionally made of thin web-like material. During the printing operation ribbon 38 passes between a rotating platen 40 (which is rotatably mounted to printer base 30) and thermal printhead 28 which is mounted on a metal printhead bracket 42 removably coupled to underside 24 of ribbon frame 26 (FIGS. 2, 3). Ribbon 38 is pulled by a motor (not shown) and associated gear train (not shown) from ribbon Supply roll 32 over gimbaling plate 14, which is substantially in contact with ribbon 38 during printer operation by way of its curved front edge 44 (FIGS. 1–3), between rotating platen 40 and thermal printhead 28, to ribbon take up roll 34 as generally shown by ribbon path 36 of FIG. 3.

In accordance with a preferred embodiment of the present invention, the width and length of integral neck portion 16 are picked small enough to allow each side (right side 17 and left side 19) of gimbaling plate 14 to deflect horizontally within a predetermined range A (FIG. 4) or vertically within a pre-determined range B (FIG. 5), or in any combination of directions thereof within the respective pre-determined ranges, under pressure from moving ribbon 38 to automatically prevent wrinkling of moving ribbon 38 during printer operation. Integral neck portion 16 functions generally as a "living hinge" allowing gimbaling plate 14 to automatically track moving ribbon 38. The automatic ribbon tracking capability provided by gimbaling plate 14 helps equalize existing stress differentials between various portions of moving ribbon 38 so as to prevent undesirable wrinkling, buckling of moving ribbon 38 along ribbon path 36.

Since integral neck portion 16 and gimbaling plate 14 are made of the same plastic material as the body of wire shroud 12, a person skilled in the art would readily recognize that plastic materials suitable for practicing the present invention must be sufficiently stiff to prevent premature breakage of substantially small neck portion 16 and/or the right and left sides (17, 19) of gimbaling plate 14 during ribbon tracking. In this regard and in accordance with another preferred embodiment of the present invention, wire shroud 12, neck portion 16 and gimbaling plate 14 are injection molded as one integral unit from a carbon fiber/polycarbonate material 46 (FIGS. 1–2) which has a high enough flexural modulus to allow neck portion ("living hinge") 16 and right and left sides (17, 19) of gimbaling plate 14 to perform as described hereinabove. A material suitable for practicing the present invention may be purchased from LNP Engineering Plastics, Inc. of Exton, Pennsylvania and is available commercially under the trademark name STAT-KON™. The preferred chemical composition of material 46 is currently sold is STAT-KON™ DCL-4413 and contains about 15% carbon fiber, about 2% silicone with the rest being polycarbonate. In general, an approximate range of 5%–30% carbon fiber may be utilized in a material of this kind. Other materials, including other plastic carbon fiber-based compositions, may be used to manufacture ribbon tracking system 10 provided such other materials do not depart from the intended purpose of the present invention.

As ribbon 38 slides over and contacts curved front edge 44 of gimbaling plate 14, each side (17, 19) of gimbaling plate 14 deflects accordingly to provide the necessary tolerance to prevent wrinkling/buckling of moving ribbon 38, i.e. to automatically correct for errors in tracking. The extent to which the right and left sides (17, 19) of gimbaling plate 14 deflect horizontally and/or vertically generally depends on the type of ribbon used, the speed of the ribbon (different ribbon speeds produce different moments on gimbaling plate 14) and the specific type of material used to manufacture gimbaling plate 14.

In accordance with yet another preferred embodiment of the present invention, vertical and horizontal stops are provided to limit the extent of travel or deflection of gimbaling plate 14 in each direction. In this regard, thermal printhead 28 serves as a vertical stop for a vertically deflecting gimbaling plate 14 (FIG. 5), while front left side 15*a* of wire shroud 12 serves as a horizontal stop for left side 19 of gimbaling plate 14 (FIG. 4) and front right side 15*b* of wire shroud 12 serves as a horizontal stop for right side 17 of gimbaling plate 14 (FIG. 4).

In one example, and as generally illustrated in FIG. 4, the range of travel A in the horizontal direction (FIG. 4) for each side (17, 19) of gimbaling plate 14 may be about 0.08 inches which is equal to the length L" of neck portion 16 and the range of travel B in the vertical direction (FIG. 5) may be about 0.027 inches. In the same example, the width W of wire shroud 12 may be about 4.98 inches which is equal to the width W' of gimbaling plate 14, the length L of wire shroud 12 may be about 2.35 inches, the length L' of gimbaling plate 14 may be about 0.48 inches, i.e. 6 times larger in length than neck portion 16, and the width W" of neck portion 16 may be about 0.19 inches, i.e. more than 26 times smaller in width than gimbaling plate 14.

The above-described novel ribbon tracking system provides a cost efficient automatic ribbon tracking solution to printer manufacturers which can be easily incorporated in a variety of printers, scanners, fax machines and the like. The ribbon tracking system of the present invention includes a single integral ribbon tracking unit which is made of a rigid carbon fiber plastic composition and does not use any screws and/or compression springs to track the ribbon during printer operation. A person skilled in the art would immediately appreciate the fact that assembly time for the integral ribbon tracking, unit itself has been reduced to zero.

Other components and/or configurations may be utilized in the above-described embodiments, provided that such components and/or configurations do not the intended purpose and scope of the present invention.

While the present invention has been described in detail with regards to the preferred embodiments, it should also be appreciated that various modifications and variations may be made in the present invention without departing from the scope or spirit of the invention. In this regard it is important to note that practicing the invention is not the applications described hereinabove. Many other applications and/or alternations may be utilized provided that such other applications and/or alterations do not depart from the intended purpose of the present invention.

It should also be appreciated by a person skilled in the art that features illustrated or described as part of one embodiment can be used in another embodiment to provide yet another embodiment such that the features are not limited to the specific embodiments described above. It is, therefore, intended that the present invention cover all such modifications, embodiments and variations as long as they come within the scope of the appended claims and their equivalents.

What is claimed is:

1. A ribbon tracking system for use in an image forming device having a printhead coupled to a ribbon frame, said system comprising a plate including a first portion coupled to said ribbon frame downstream from said printhead, a second portion spaced apart from said first portion and adapted to contact a moving ribbon at a first edge, and a substantially small integral neck region between said first and second portions adapted to permit said second portion to deflect toward and/or away from said first portion to help equalize stress differentials between various portions of said moving ribbon to prevent wrinkling of said ribbon.

2. The system of claim 1, wherein said second portion is gimbaled on said integral neck region relative to said first portion.

3. The system of claim 2, wherein the length of said integral neck region defines the horizontal range of deflection of said gimbaled second portion relative to said first portion.

4. The system of claim 3, wherein a first side of said first portion serves as a horizontal deflection stop for said gimbaled second portion.

5. The system of claim 2, wherein said gimbaled second portion is disposed substantially parallel to said first portion.

6. The system of claim 2, wherein said first edge of said gimbaled second portion is disposed under said printhead.

7. The system of claim 6, wherein said printhead serves as a vertical deflection stop for said gimbaled second portion.

8. The system of claim 2, wherein said integral neck region is disposed centrally between said first and second portions and adapted to function substantially as a living hinge for said gimbaled second portion.

9. The system of claim 1, wherein each of said first portion, said second portion and said integral neck region comprises about 15% carbon fiber, about 2% silicone and about 83% polycarbonate.

10. The system of claim 1, wherein each of said first portion, said second portion and said integral neck region comprises about 5% to 30% carbon fiber.

11. A ribbon tracking device, comprising at least one plate for covering printer wiring under a ribbon frame having at least one head portion for contacting a moving ribbon, at least one body portion coupled to said ribbon frame and at least one substantially small integral neck portion adapted to permit said at least one head portion to deflect toward and/or away from said at least one body portion in accordance with said moving ribbon for preventing wrinkling and/or buckling of said ribbon.

12. The ribbon tracking device of the claim 11, wherein said at least one head portion is gimbaled on said at least one substantially small integral neck portion relative to said at least one body portion.

13. The ribbon tracking device of claim 12, wherein the length of said at least one integral neck portion defines the horizontal range of deflection of said at least one gimbaled head portion relative to said at least one body portion.

14. The ribbon tracking device of claim 12, wherein a first side of said at least one body portion serves as a horizontal deflection stop for said at least one gimbaled head portion.

15. The ribbon tracking device of claim 12, wherein said at least one gimbaled head portion is disposed substantially parallel to said at least one body portion.

16. The ribbon tracking device of claim 12, wherein said at least one body portion is coupled downstream from a printhead coupled to said ribbon frame.

17. The ribbon tracking device of claim 16, wherein a front edge of said at least one gimbaled head portion is disposed under said printhead, said front edge being in contact with said moving ribbon.

18. The ribbon tracking device of claim 17, wherein said printhead serves as a vertical deflection stop for said at least one gimbaled head portion.

19. The ribbon tracking device of claim 12, wherein said at least one substantially small integral neck portion is disposed centrally between said at least one head and body portions and functions substantially as a living hinge for said at least one gimbaled head portion.

20. The ribbon tracking device of claim 11, wherein each of said at least one head portion, said at least one body portion and said at least one integral neck portion comprised about 15% carbon fiber, about 2% silicone and about 83% polycarbonate.

21. The ribbon tracking device of claim 11, wherein each of said at least one head portion, said at least one body portion and said at least one integral neck portion comprises about 5% to 30% carbon fiber.

* * * * *

UNITED STATES PATENT AND TRADEMARK OFFICE

CERTIFICATE OF CORRECTION

PATENT NO. : 6,491,455 B1
DATED : December 10, 2002
INVENTOR(S) : Caleb Bryant

It is certified that error appears in the above-identified patent and that said Letters Patent is hereby corrected as shown below:

Title page,
Item [73] Assignee, should read -- ZIH Corp., a Delaware Corporation with it's principal office in Hamilton, Bermuda --

Signed and Sealed this

Twenty-fourth Day of August, 2004

JON W. DUDAS
*Director of the United States Patent and Trademark Office*